US009520118B2

(12) United States Patent
Canivell Grifols et al.

(10) Patent No.: US 9,520,118 B2
(45) Date of Patent: Dec. 13, 2016

(54) ADJUSTABLE SUPPORT FOR CONTROL DEVICES FOR ELECTRONIC MUSICAL INSTRUMENTS AND SIMILAR

(71) Applicant: LLEVINAC, S.L., Barcelona (ES)

(72) Inventors: Jordi Canivell Grifols, Barcelona (ES); David Mañosa Ripoll, Barcelona (ES); Eulalia Llovet Vidal, Barcelona (ES); Marta Hereu Ros, Lloret de Mar (ES)

(73) Assignee: LLEVINAC, S.L., Barcelona (ES)

( * ) Notice: Subject to any disclaimer, the term of this patent is extended or adjusted under 35 U.S.C. 154(b) by 0 days.

(21) Appl. No.: 14/888,328

(22) PCT Filed: Jun. 12, 2015

(86) PCT No.: PCT/ES2015/070465

§ 371 (c)(1),
(2) Date: Oct. 30, 2015

(87) PCT Pub. No.: WO2015/193526

PCT Pub. Date: Dec. 23, 2015

(65) Prior Publication Data

US 2016/0171959 A1 Jun. 16, 2016

(30) Foreign Application Priority Data

Jun. 16, 2014 (ES) ..... 201430915

(51) Int. Cl.
*G10H 1/34* (2006.01)
*G10G 5/00* (2006.01)

(52) U.S. Cl.
CPC ..... *G10H 1/348* (2013.01); *G10G 5/00* (2013.01); *G10H 2210/155* (2013.01)

(58) Field of Classification Search
CPC ..... G10D 13/006; G10C 3/26
USPC ..... 84/721, 426, 746, 366, 422.1
See application file for complete search history.

(56) References Cited

U.S. PATENT DOCUMENTS 6,215,055 B1 * 4/2001 Saravis ..... G10H 1/348 84/422.1
6,459,023 B1 10/2002 Chandler
2003/0061930 A1 4/2003 Green
2004/0250673 A1 * 12/2004 Salerno ..... G10H 1/32 84/746
2007/0295190 A1 12/2007 Collins
2011/0271821 A1 11/2011 McKinney et al.
2014/0131543 A1 5/2014 Goto

FOREIGN PATENT DOCUMENTS

WO 2014/114833 A1 7/2014

* cited by examiner

*Primary Examiner* — Kimberly Lockett
(74) *Attorney, Agent, or Firm* — Knobbe Martens Olson & Bear LLP

(57) ABSTRACT

The support comprises a board provided with multiple grooves on the upper face thereof, along which attachment brackets can be fitted for the movable control devices, pedals and similar devices on the board, allowing the different control devices to be attached by previously fixing the brackets on the grooves of the board at the required places and the subsequent fixed positioning of the control devices and pedals on the brackets, by means of attachment elements thereof. The grooves of the board have flanges along the upper edges thereof for holding the attachment elements of the brackets.

8 Claims, 5 Drawing Sheets

ADJUSTABLE SUPPORT FOR CONTROL DEVICES FOR ELECTRONIC MUSICAL INSTRUMENTS AND SIMILAR

CROSS-REFERENCE TO RELATED APPLICATIONS

This application is the U.S. National Phase under 35. U.S.C. §371 of International Application PCT/ES2015/070465, filed Jun. 12, 2015, which claims priority to Spanish Patent Application No. 201430915, filed Jun. 16, 2014.

The present invention relates to an adjustable support for control devices such as pedals and similar devices, for electronic musical instruments such as electric guitars, for example.

The support for control devices and pedals for electronic musical instruments according to the present invention is intended to overcome one of the drawbacks presented by the devices intended for similar purposes that are known at present.

Some of the adjustable supports known at present are characterised by a complex construction in which various longitudinal extruded profiles are attached by a system of nuts and bolts which are housed in guides in the above-mentioned longitudinal profiles, said longitudinal profiles each providing an upper surface intended to receive the electronic devices and pedals for the control of electric musical instruments such as guitars and similar instruments.

The object of the present invention is to disclose an adjustable support of great simplicity and flexibility of use, allowing a fast assembly of the various devices and an easy adjustment thereof at the positions where the user wishes to place said devices.

The adjustable character therefore extends to the electronic control devices and pedals and also to the slope of the support assembly, generally known as a 'pedal board', for supporting in a particular manner the control pedals which the user uses during his or her musical performance.

The support of the present invention is based on a board provided with parallel longitudinal grooves on the upper face thereof, which are capable of receiving movable attachment brackets provided with elements for attaching the electronic control devices and pedals, such as suction pads, which allows the various devices and pedals to be attached very easily in the appropriate position on the board, as it is easy enough to arrange the movable brackets in a suitable position and then slide the electronic devices and pedals on the board for the attachment thereof with the suction pads or other retaining elements of the movable brackets.

Optionally, said board may comprise parallel longitudinal grooves on the lower face thereof which are used to attach other types of elements along said grooves.

The board of the adjustable support of the present invention will be produced preferably, but not in a limiting way, as a single piece of a synthetic or metallic material, such as aluminium, for example, having multiple parallel grooves on the upper face thereof provided with flanges at the edges thereof for holding the bases of the brackets in any position along said grooves, which allows the attachment position of the bracket and thus the electronic devices and pedals for the electronic musical instrument to be located at any point on the board.

The individual attachment brackets preferably comprise small right-angled profiles which can be moved along the grooves of the board of the adjustable support, having means for attachment at the required position in any groove of the board. Said attachment means will comprise a small rotating part in the form of a key, which has a position for insertion in the groove and a position, after rotation through 90°, for example, for holding said means inside the groove, owing to the flanges that said grooves have along the upper edges thereof.

The means which the brackets have for holding the electronic control elements, pedals and other devices consist preferably of suction pads, which will allow the control devices or pedals to be easily held or applied once the brackets that carry said suction pads are fixed in the required positions.

As will be appreciated, the basic inventive concept lies in the arrangement of a board provided with longitudinal grooves with flanges at the edges, combined with brackets that can be moved along said grooves, said brackets having means of attachment at any required point in said grooves and other means for holding or retaining the control devices and pedals. The precise realisation of said brackets can vary provided that they comply with the characteristics of the invention.

In a preferred embodiment, the holding brackets will comprise a right-angled body in which one of the sides is intended to slide on the board, along the selected groove and has means for the attachment thereof along the groove which may consist, as mentioned above, of a part in the form of a rotating key, which has a position for its insertion into the groove and another transverse position in which it is held within the groove after rotation through a given angle, for example, 90°. The attachment means of the control device or pedal that is to be attached to the board of the adjustable support may consist, although not in a limiting way, of a suction pad attached to the side of the profile of the bracket which is arranged perpendicular to the board.

For a better understanding, the accompanying drawings show an explanatory example of the adjustable support for control devices, pedals and similar elements for electric or other musical instruments, according to the present invention.

Figure 4:
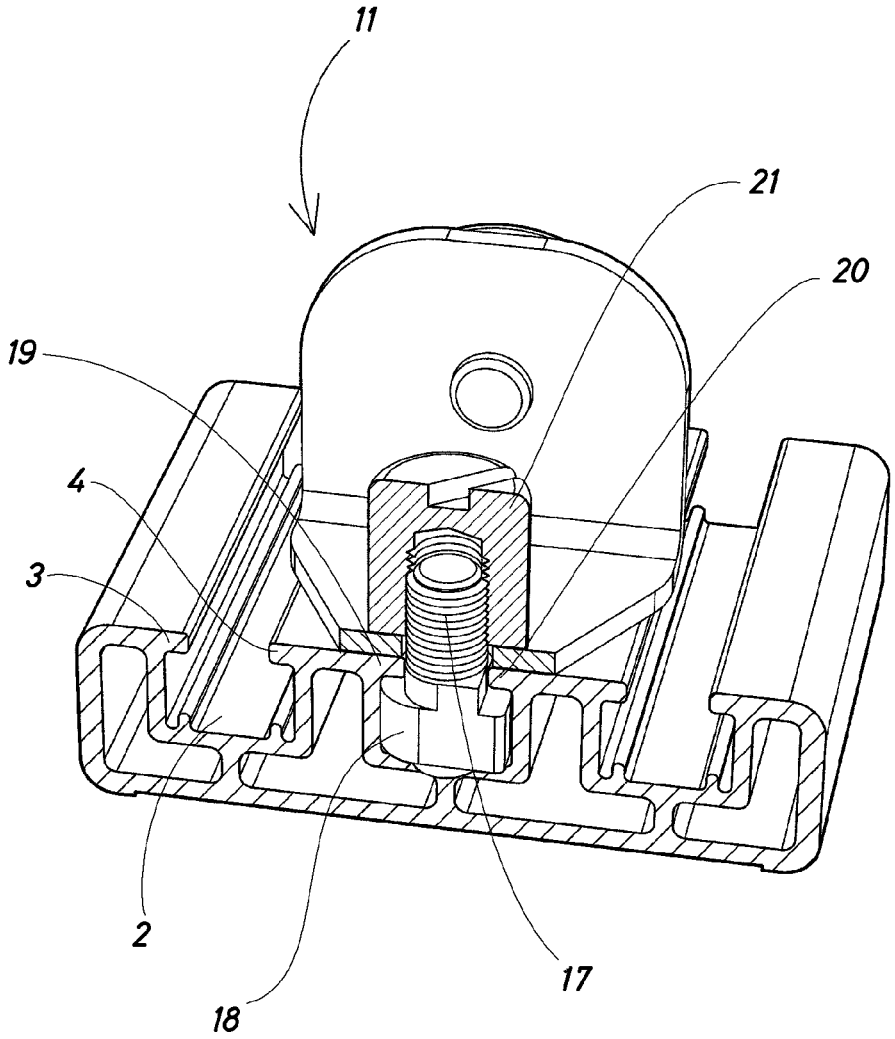
FIG. 4 is a perspective view, partly in cross section, which shows the arrangement of an attachment bracket on the board of the adjustable support.
Figure 5:
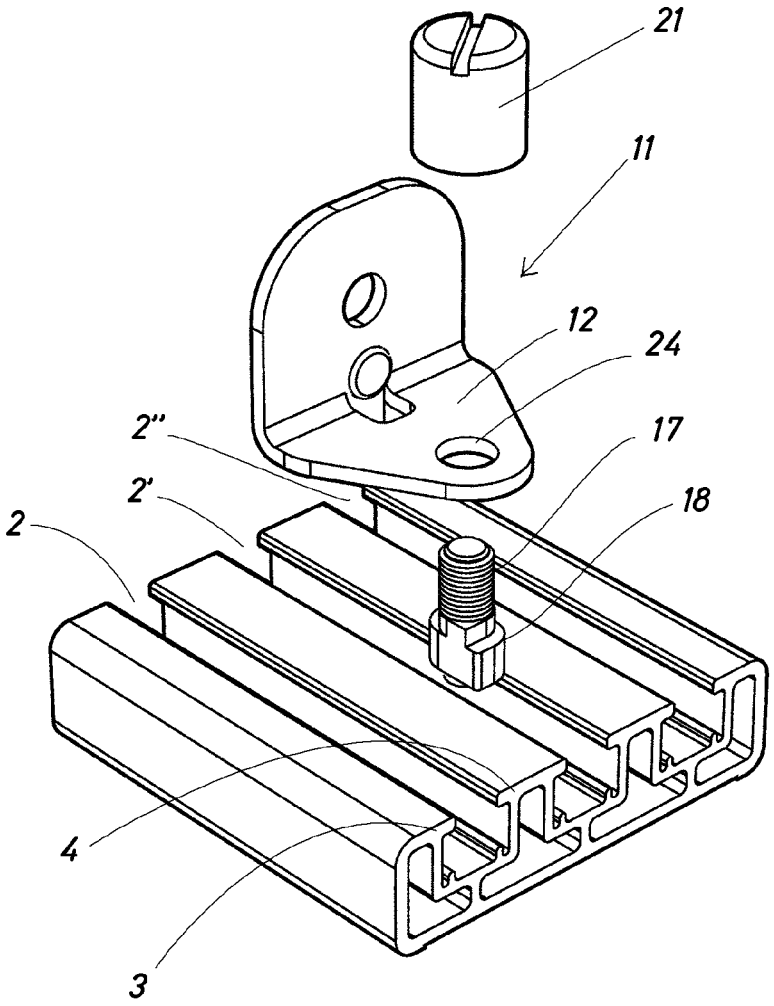
FIG. 5 is a perspective view showing the elements of a disassembled bracket and the position thereof relative to the board of the adjustable support of the present invention.

As shown in the figures, the adjustable support -1- comprises basically a board, preferably made in one piece, provided with multiple grooves, for example -2-, -2'-, -2"-, etc., which, as can be seen in FIGS. 4 and 5, run parallel to one another and are provided with longitudinal flanges which extend along the edges thereof, as indicated by the numerals -3- and -4- in the groove -2-. Said board may be provided with sides for closure, not shown in the figures, which could delimit the board by the edges thereof.

The material used to produce the board may vary provided that it fulfils the functions for which it is intended by the present invention, non-limiting examples being a plastics material with adequate characteristics of hardness and mechanical strength or alternatively an easily extruded metal such as an aluminium alloy.

As is usual in the prior art, the board may have bottom height-adjustable stops (not shown) for adjusting the angle thereof.

Figure 1:
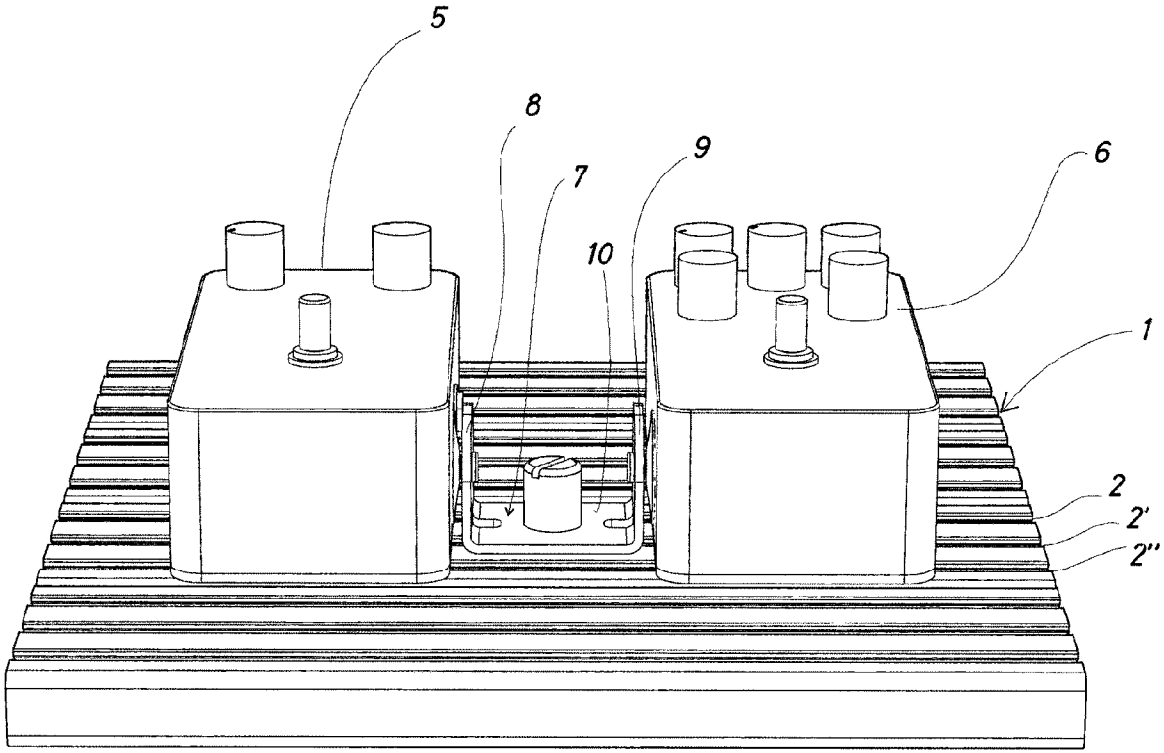
FIG. 1 is a perspective view of an example of an adjustable support produced in accordance with the present invention, with a double bracket.

FIG. 1 shows, by way of example, the arrangement of the control elements -5- and -6- which could also be adjustment pedals or other devices, intended for the control and adjustment of the functional characteristics of electric or other types of musical instruments. The arrangement of the grooves -2-, -2'-, -2"- extending over the entire upper face of the board will allow the electronic and other types of control devices -5- and -6- to be attached at any desired location of the surface of the board of the adjustable support, said devices being attached at the desired location by means of brackets which are movable along said grooves -2-, -2'-, -2"-. FIG. 1 shows one of these brackets -7-, of the double type, which has two vertical arms -8- and -9- and a base -10-. The base -10- will carry a device for its attachment in one of the longitudinal grooves -2-, -2'-, -2"- and each of the vertical arms -8- and -9- will carry element for attaching the devices -5- and -6-, for example, suction pads or similar devices as will be shown below in more detail.

The attachment brackets may be double, as shown in FIG. 1, or single, as shown in FIGS. 2 to 5. The single brackets, as shown in FIGS. 2 to 5 with the reference numeral -11-, have a base -12- which will be arranged on the board of the adjustable support and which has a vertical arm -13- in an arrangement similar to that of the bracket -7- of FIG. 1, such that the base -12- has means for the attachment thereof at any point of one of the longitudinal grooves of the board, whereas the vertical side has elements for the attachment of the adjustment device or pedal in the desired position on the board of the adjustable support.

Figure 2:
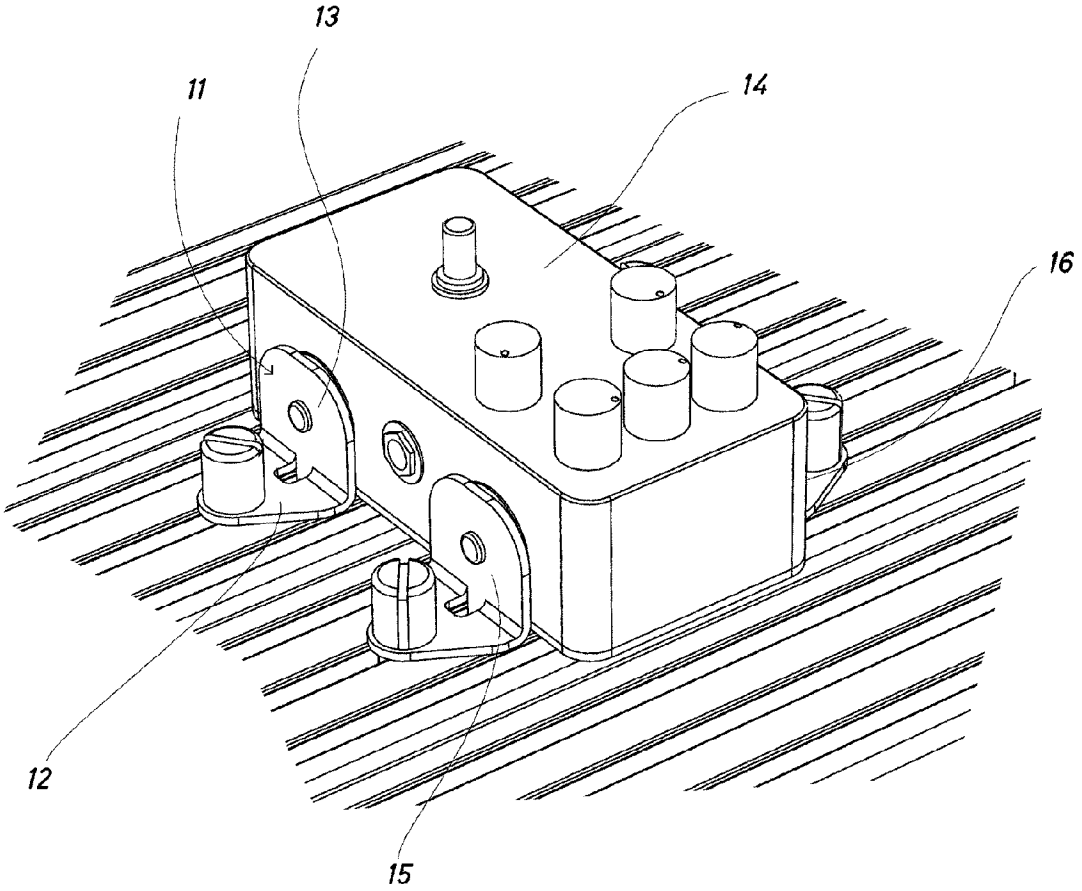
FIG. 2 is a perspective view of a portion of the board of the adjustable support of the present invention, showing the attachment of an electronic control device by means of single brackets.

The illustration in FIG. 2 shows the attachment of a control device -14- by means of various single brackets, such as the brackets -13-, -15- and -16-; it should be noted that the number of brackets used will vary depending on the dimensions and weight of the device that is to be attached.

Figure 3:
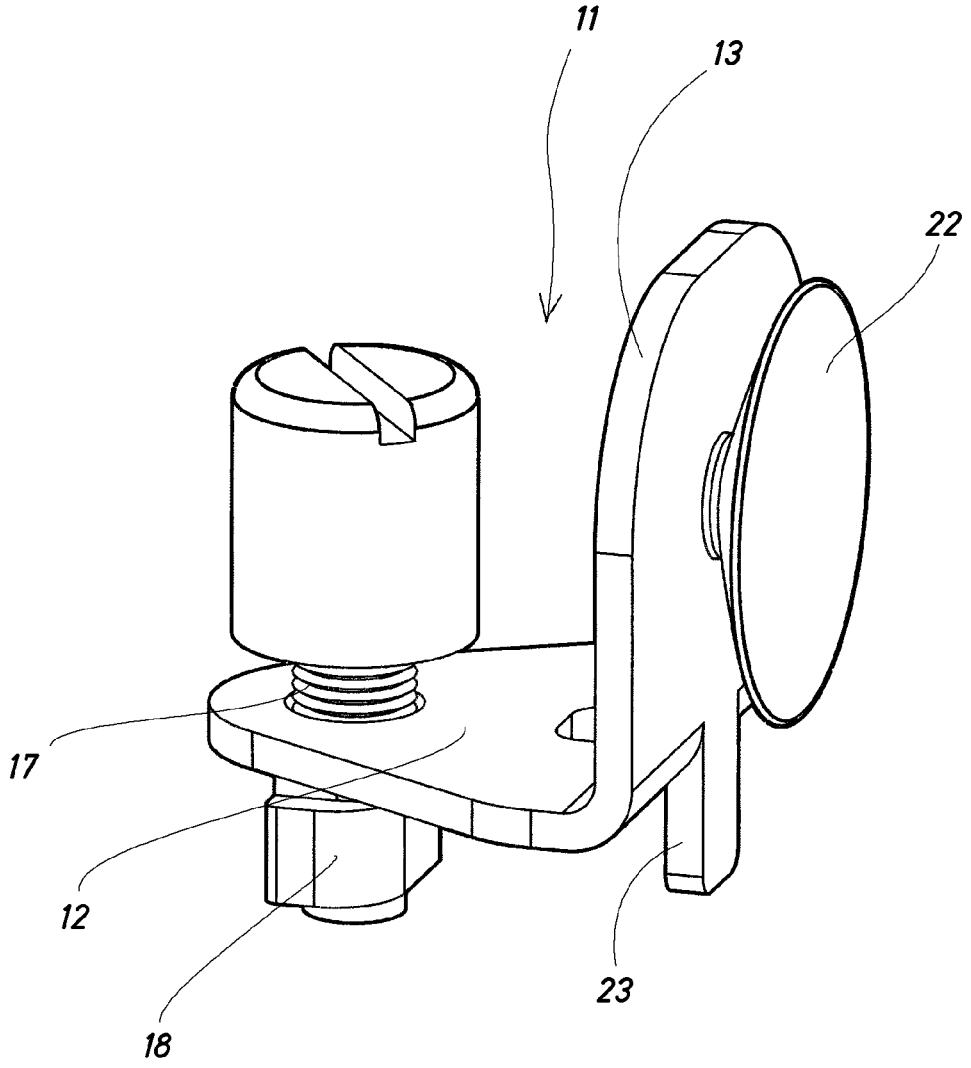
FIG. 3 is a perspective view of a movable attachment bracket produced in accordance with the present invention.

FIG. 3 shows in detail one of the single brackets -11-. A threaded lug -17- provided with an elongated lower head -18- which forms a sort of key with the lug -17- passes through the base -12- in such a way that in one position, as shown in FIG. 5, it is easily inserted in the selected groove of the board, whereas on rotating the lug -17-, for example through 90°, the head -18- is arranged as shown in FIG. 4, in which it is observed that said head cannot be removed owing to the existence of the longitudinal flanges -19- and -20- of the groove into which the bracket -11- has been inserted. The bracket is attached at the required point of the groove of the board, for example, by means of the knurled nut -21- fitted to the threaded lug -17- so that it is very easy to attach the bracket at the required place in the longitudinal groove, meaning that said bracket will be in position to receive the electronic device at the required place. The bracket will have variable means, such as a suction pad -22-, for example, for attaching said electronic device, fitted to the vertical side -13- of the bracket -11-. However, said suction pad device is not the only device that can be incorporated in the bracket -11- in order to attach the control device, pedal or other element, since said element could take many different forms.

Similarly, the attachment bracket -11- can be produced as a curved, die-cut profile or as a moulded part made, for example, of a plastics material, etc. In the version illustrated in the drawings, the bracket is shown in the form of a bent, die-cut metal profile forming an optional guide finger -23- to be inserted in the corresponding groove of the board. In the case of a moulded bracket, the structure could be similar, and may or may not have an extension finger for guiding the bracket and apertures for incorporating the lug of the attachment device or "key" and also the attachment element -22-, consisting of a suction pad or other attachment element.

As shown in FIG. 5, the element for attaching the bracket formed by the lug -17- and the lower head -18- will be situated at the required point of the selected groove in a position such that the head -18-, which has a generally elongated structure, can enter the groove -2'- and subsequently, once rotated through a given angle, for example 90°, will not then be able to come out from inside the groove. Once this situation is achieved, the angular element of the bracket will be incorporated by inserting the lug -17- into the aperture -24- of the base -12- and then fitting the knurled nut -21-, which optionally may be attached by means of a screwdriver in the grooved head thereof. This arrangement makes it possible to attach any control device quickly and easily on the board of the adjustable support according to the present invention.

As will be appreciated, persons skilled in the art may include multiple variations in the elements of the adjustable support of the present invention, taking account of the teachings deduced from the description and the accompanying drawings, and said variants should be considered as falling within the scope of the present invention if they are within the scope of the following claims.

What is claimed is:

1. An adjustable support for control devices for electronic musical instruments, pedals or other devices, comprising:

a board comprising multiple parallel attachment grooves on an upper face of the adjustable support, and a plurality of brackets, wherein each of the plurality of brackets comprises a fastener to secure the bracket at a desired position in respective multiple parallel attachment grooves, the brackets configured for attaching the control devices, pedals or other devices on the board by an attachment element coupled to each of the plurality of brackets.

2. The adjustable support according to claim 1, wherein each multiple parallel attachment groove comprises flanges along an upper edge thereof, for holding the fastener.

3. The adjustable support according to claim 2, wherein each of the plurality of brackets further comprises:

a base which is movable on the board, and a vertical arm comprising the attachment element for attaching the control devices.

4. The adjustable support according to claim 3, wherein the fastener comprises:

a lug inserted in an aperture in the base, and an elongate lower head, a length in longitudinal direction of which is longer than a gap defined by the flanges in the respective multiple parallel attachment grooves and a length in transverse direction of which is shorter than the gap.

5. The adjustable support according to claim 4, wherein the fastener is rotatable.

6. The adjustable support according to claim 4, wherein the lug of the attachment element of the bracket is threaded and receives a knurled nut for locking at the desired position in respective multiple parallel attachment grooves.

7. The adjustable support according to claim 1, wherein the attachment element is a suction pad.

8. The adjustable support according to claim 4, wherein the elongate lower head is insertable in any groove of the board and which is held within the groove after rotation on its axis.

* * * * *